US009082571B2

(12) United States Patent
Seo

(10) Patent No.: US 9,082,571 B2
(45) Date of Patent: Jul. 14, 2015

(54) ARC EXTINGUISHING UNIT FOR MOLDED CASE CIRCUIT BREAKER

(71) Applicant: LSIS CO., LTD., Anyang-si, Gyeonggi-do (KR)

(72) Inventor: In Su Seo, Seoul (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 14/251,408

(22) Filed: Apr. 11, 2014

(65) Prior Publication Data

US 2014/0339196 A1 Nov. 20, 2014

(30) Foreign Application Priority Data

May 14, 2013 (KR) ..... 10-2013-0054563

(51) Int. Cl.

| | |
|---|---|
| ***H01H 33/00*** | (2006.01) |
| ***H01H 9/36*** | (2006.01) |
| ***H01H 73/18*** | (2006.01) |
| ***H01H 33/08*** | (2006.01) |

(52) U.S. Cl.

CPC ..... *H01H 33/08* (2013.01); *H01H 9/362* (2013.01); *H01H 73/18* (2013.01)

(58) Field of Classification Search

CPC ..... H01H 9/345; H01H 9/346; H01H 9/36; H01H 9/443; H01H 9/362; H01H 2009/365

USPC ..... 218/149, 23, 25, 46; 335/133, 134, 177, 335/201, 202, 207

See application file for complete search history.

(56) References Cited

U.S. PATENT DOCUMENTS

| | | | | |
|---|---|---|---|---|
| 2,942,083 | A | 6/1960 | Walker et al. | |
| 4,612,426 | A * | 9/1986 | Maier et al. | 218/151 |
| 5,898,152 | A * | 4/1999 | Kim | 218/149 |
| 2003/0048586 | A1 * | 3/2003 | Faber et al. | 361/1 |
| 2008/0135525 | A1 * | 6/2008 | Claeys et al. | 218/151 |

FOREIGN PATENT DOCUMENTS

| | | |
|---|---|---|
| JP | 50-126283 | 10/1975 |
| JP | 62-82616 | 4/1987 |
| JP | 05-334941 | 12/1993 |
| KR | 200346453 | 3/2004 |
| KR | 200393296 | 8/2005 |

OTHER PUBLICATIONS

European Patent Office Application Serial No. 14164558.0, Search Report dated Oct. 15, 2014, 10 pages.

(Continued)

*Primary Examiner* — Renee Luebke
*Assistant Examiner* — William Bolton
(74) *Attorney, Agent, or Firm* — Lee, Hong, Degerman, Kang & Waimey

(57) ABSTRACT

There is provided an arc extinguishing unit of a molded case circuit breaker (MCCB) having a structure in which grids and side plates forming an arc chamber are coupled in an inserted manner, facilitating an operation, and intervals of grids are uniformly maintained and a configuration of the grids is not damaged, thus maintaining stable performance and allowing for maintenance.

5 Claims, 8 Drawing Sheets

(56) References Cited

OTHER PUBLICATIONS

Korean Intellectual Property Office Application Serial No. 10-2013-0054563, Notice of Allowance dated Jun. 11, 2014, 2 pages.

Japan Patent Office Application Serial No. 2014-099445, Office Action dated Mar. 5, 2015, 2 pages.

* cited by examiner

ARC EXTINGUISHING UNIT FOR MOLDED CASE CIRCUIT BREAKER

CROSS-REFERENCE TO RELATED APPLICATION

Pursuant to 35 U.S.C. §119(a), this application claims the benefit of earlier filing date and right of priority to Korean Application No. 10-2013-0054563, filed on May 14, 2013, the contents of which is incorporated by reference herein in its entirety.

BACKGROUND OF THE INVENTION

1. Field of the Invention

The present disclosure relates to an arc extinguishing unit of a molded case circuit breaker (MCCB), and more particularly, to an arc extinguishing unit of an MCCB having a structure in which grids and side plates forming an arc chamber are coupled in an inserted manner, facilitating an operation, and intervals of grids are uniformly maintained and a configuration of the grids is not damaged, thus maintaining stable performance and allowing for maintenance.

2. Background of the Invention

In general, an MCCB is an electric device for automatically breaking a circuit in an electrically overloaded or in the event of a short-circuit accident to protect circuits and a load. An MCCB includes a terminal unit allowing for connection between a power source side and a load side, a mechanism unit opening and closing a stator and a mover to be mechanically brought into contact, a trip unit sensing an overcurrent or a short circuit current flowing from a power source and inducing the mechanism unit to perform trip operation, and an arc extinguishing unit for extinguishing an arc generated when a fault current is interrupted.

A short circuit current intended to be interrupted in an MCCB is a current greater by tens of times than a rated current of the MCCB, and a short circuit current sufficient for the MCCB to interrupt is an interrupting capacity. An MCCB limits a short circuit current to a current level lower than a predetermined current to interrupt a current, and this is called current limitation interruption. In general, an MCCB has current limitation performance in proportion to arc extinguishing capability of an arc extinguishing unit and in inverse proportion to an operating time of a mechanism unit.

Performing tripping in the event of a fault current and extinguishing an arc and discharging it are the main functions of an MCCB to interrupt a fault current to protect a product, a load, and a line and are directly connected with performance of the MCCB. An arc chamber of an arc extinguishing plays a key role in the performance, and an assembled state of the component, maintaining an assembled configuration, a position thereof, and the like, significantly affect performance of the MCCB.

Korean Utility Model Registration No. 20-0462420 entitled "Arc extinguishing unit of Small MCCB" and Korean Utility Model Registration No. 20-0393296 entitled "Arc extinguishing unit of MCCB" may be referred to as related art arc extinguishing mechanisms.

FIGS. 1 through 5 illustrate an example of a related art. FIG. 1 is a cross-sectional view illustrating a single pole breaking unit of an MCCB including an arc extinguishing unit according to a related art, FIG. 2 is a perspective view illustrating a part of the arc extinguishing unit in the single pole breaking unit of FIG. 1, FIG. 3 is a partially exploded perspective view of the arc extinguishing unit of FIG. 1, FIG. 4 is an assembled view of the arc extinguishing unit of FIG. 1, and FIG. 5 is a perspective view of a grid of FIG. 4.

When a rate current flows in an arc extinguishing mechanism, a stator 102 and a mover 103 are maintained in a contact state, but when a fault current such as an overcurrent or a short circuit current is generated, the mover 103 is separated from the stator 102 by electrodynamic repulsion force generated between a fixed contact of the stator 102 and a movable contact of the mover 103, interrupting the current.

The moment the mover 103 is separated, an arc is generated between the fixed contact and the movable contact, and the generated arc is induced by an arc runner to be moved to an arc chamber 121. In this case, the arc is divided by a grid 122 of the arc chamber 121 to allow an arc voltage to be increased to be higher than a source voltage, thus limiting the short circuit current to extinguish the arc.

As for a configuration of the arc chamber 121 in the related art, the arc chamber 121 includes a plurality of grids 122 arranged at predetermined intervals in an outer side of a casing 101 from a rotary trace of the mover 103, a pair of side plates 123*a* coupled to both sides of the grids 122, hybrid fixing plates 123 extending from the side plates 123*a*, and lateral magnets 128 coupled to rear surfaces of the hybrid fixing plates 123.

Here, the hybrid fixing plates 123 are fixed to the grids 122 such that protrusions 122*a* of the grids 122 are respectively inserted into holes 123*b* of the side plates 123*a*, so as to be fixed in a caulking manner.

In this case, however, the caulking operation may cause the grids 122 to be deformed, broken, twisted, or the like, and the grids 122 may be released due to a defective caulking operation or omission during transportation or when an end product is assembled. In addition, since the caulking operation is performed a plurality of times, a processing time is lengthened, productivity is degraded, grid intervals of the grids 122 are poorly maintained, and the like, and production costs are increased. In addition, maintenance is not possible.

SUMMARY OF THE INVENTION

Therefore, an aspect of the detailed description is to provide an arc extinguishing unit of a molded case circuit breaker (MCCB) having a structure in which grids and side plates forming an arc chamber are coupled in an inserted manner, facilitating an operation, and intervals of grids are uniformly maintained and a configuration of the grids is not damaged, thus maintaining stable performance and allowing for maintenance.

To achieve these and other advantages and in accordance with the purpose of this specification, as embodied and broadly described herein, an arc extinguishing unit of a molded case circuit breaker (MCCB) including a casing, a stator connected to a load or a power source, and a mover rotatably installed within the casing such that it is brought into contact with or separated from the stator, including: a plurality of grids arranged at predetermined intervals in an outer side of a movement trace of the mover; a pair of side plates including two-stage flat plates having a step cross-section and including a first flat plate fixing one end portions of the grids to form an arc chute and a second flat plate forming an arc chamber together with a lower surface of the grids; and a pair of lateral magnets fixedly installed on rear surfaces of the second plates.

Here, an intermediate protrusion formed on a lateral surface of each of the grids has a first stop projection formed on one side thereof, a second stop projection is formed on a lower surface of each grid, a first installation hole is formed on the first plate to allow the intermediate protrusion to be inserted therein, and a connection portion formed between the first flat plate and the second flat plate has a second installation hole to which the second projection is inserted.

An upper protrusion and a lower protrusion may be formed above and below the intermediate protrusion, respectively, on both sides of the grids.

A third installation hole may be formed in the first flat plate to allow the lower protrusion to be insertedly coupled therein.

A support protrusion is formed between the third installation recesses to provide bearing power by virtue of shear force and frictional contact when the grids are coupled to the side plates and to serve to separate the respective grids at predetermined intervals.

The first stop projection and the second stop projection may be formed in an outer side based on a contact point between the first flat plate and the connection portion.

In the case of the arc extinguishing unit of an MCCB according to exemplary embodiments of the present disclosure, since the grids and the side plates forming an arc chamber are formed to be coupled in an inserting manner, an operation may be facilitated.

Also, since the grids are maintained at uniform intervals and a shape thereof is not damaged, stable performance may be maintained.

In addition, since the grids and the side plates are separable, maintenance may be facilitated.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Figure 1:
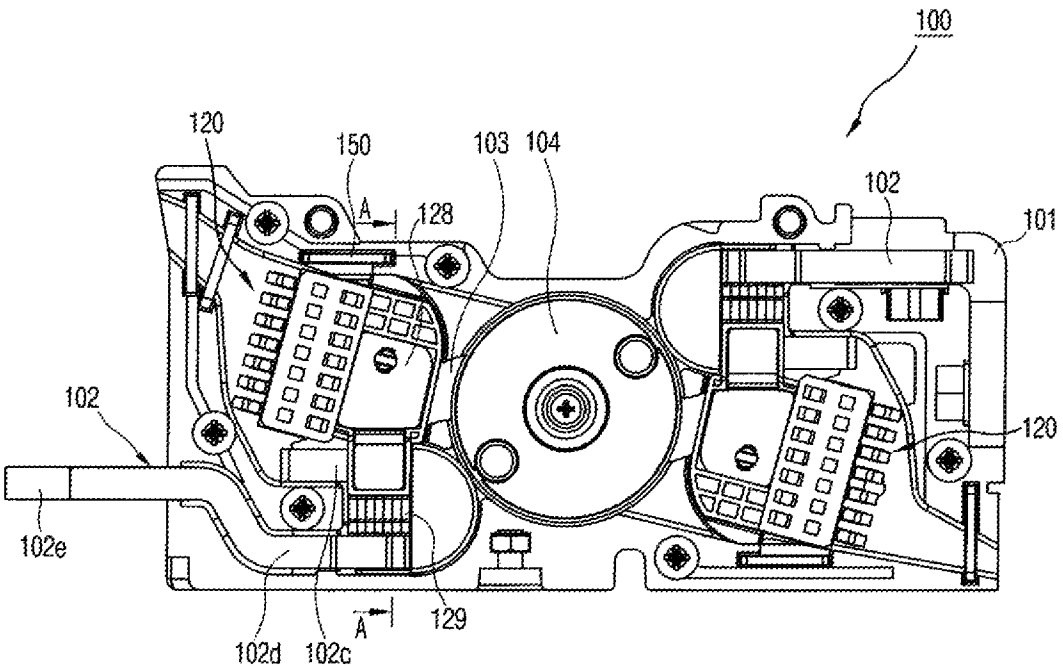
FIG. 1 PRIOR ART
FIG. 1 is a cross-sectional view illustrating a single pole breaking unit of a molded case circuit breaker (MCCB) including an arc extinguishing unit according to a related art.
Figure 2:
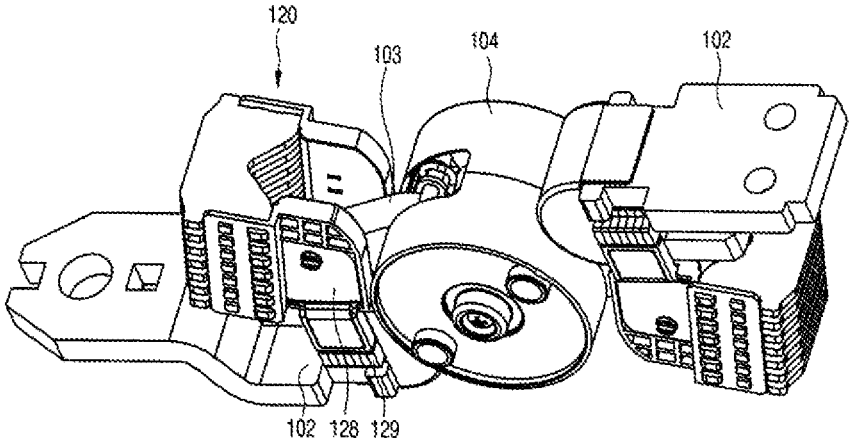
FIG. 2 PRIOR ART
FIG. 2 is a perspective view illustrating a part of the arc extinguishing unit in the single pole breaking unit of FIG. 1.
Figure 3:
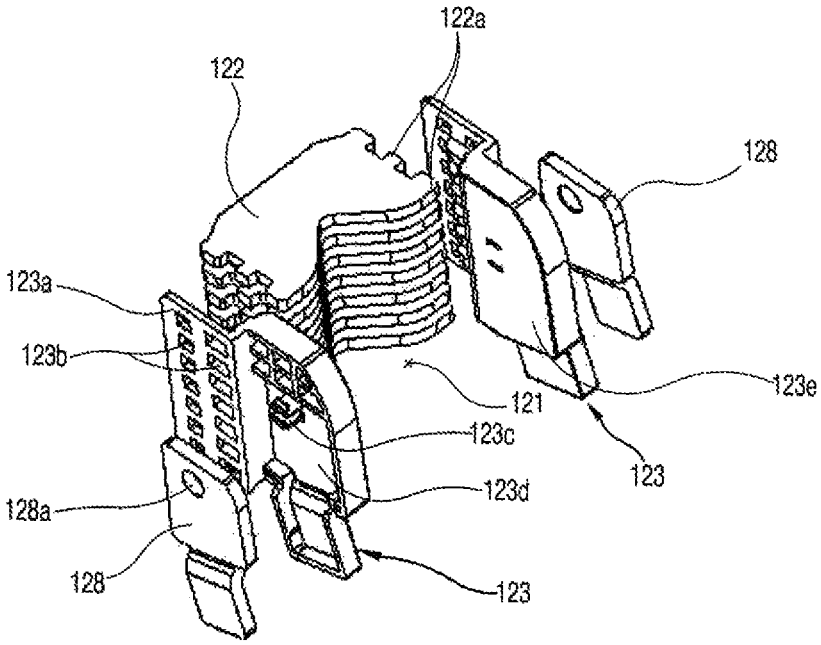
Fig.3 PRIOR ART
FIG. 3 is a partially exploded perspective view of the arc extinguishing unit of FIG. 1.
Figure 4:
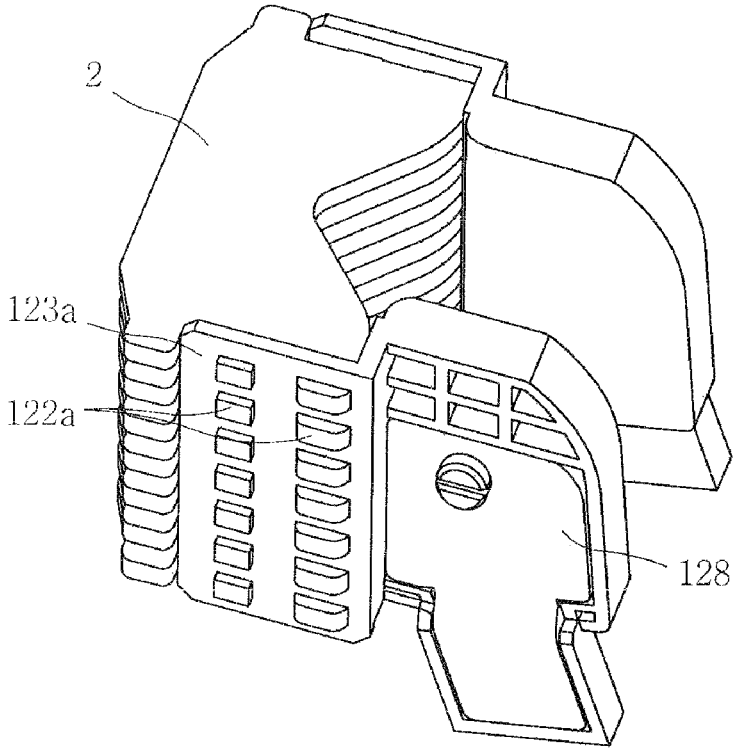
Fig.4 PRIOR ART
FIG. 4 is an assembled view of the arc extinguishing unit of FIG. 1.
Figure 5:
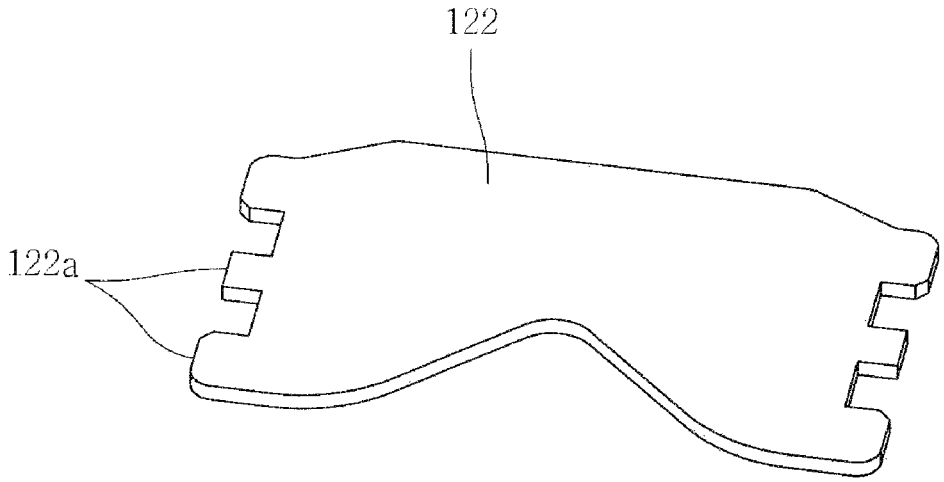
Fig.5 PRIOR ART
FIG. 5 is a perspective view of a grid of FIG. 4.

Description will now be given in detail of the exemplary embodiments, with reference to the accompanying drawings. For the sake of brief description with reference to the drawings, the same or equivalent components will be provided with the same reference numbers, and description thereof will not be repeated.

An arc extinguishing unit of a molded case circuit breaker (MCCB) including a casing, a stator connected to a load or a power source, and a mover rotatably installed within the casing such that it is brought into contact with the stator or separated therefrom according to an exemplary embodiment of the present disclosure includes a plurality of grids 10 arranged at predetermined intervals outside of a movement trace of the mover; a pair of side plates 20 including two-stage flat plates having a step cross-section and including a first flat plate 21 fixing one end portions of the grids 10 to form an arc chute and a second flat plate 27 forming an arc chamber together with a lower surface of the grids 10; and a pair of lateral magnets 30 fixedly installed on rear surfaces of the second plates 27.

Here, an intermediate protrusion 12 formed on a lateral surface of each of the grids 10 has a first stop projection 12*a* formed on one side thereof. A second stop projection 14 is formed on a lower surface of each grid 10. A first installation hole 22 is formed on the first plate 21 to allow the intermediate protrusion 12 to be inserted therein. A connection portion 25 formed between the first flat plate 21 and the second flat plate 27 has a second installation hole 26 to which the second projection 14 is inserted.

Figure 6:
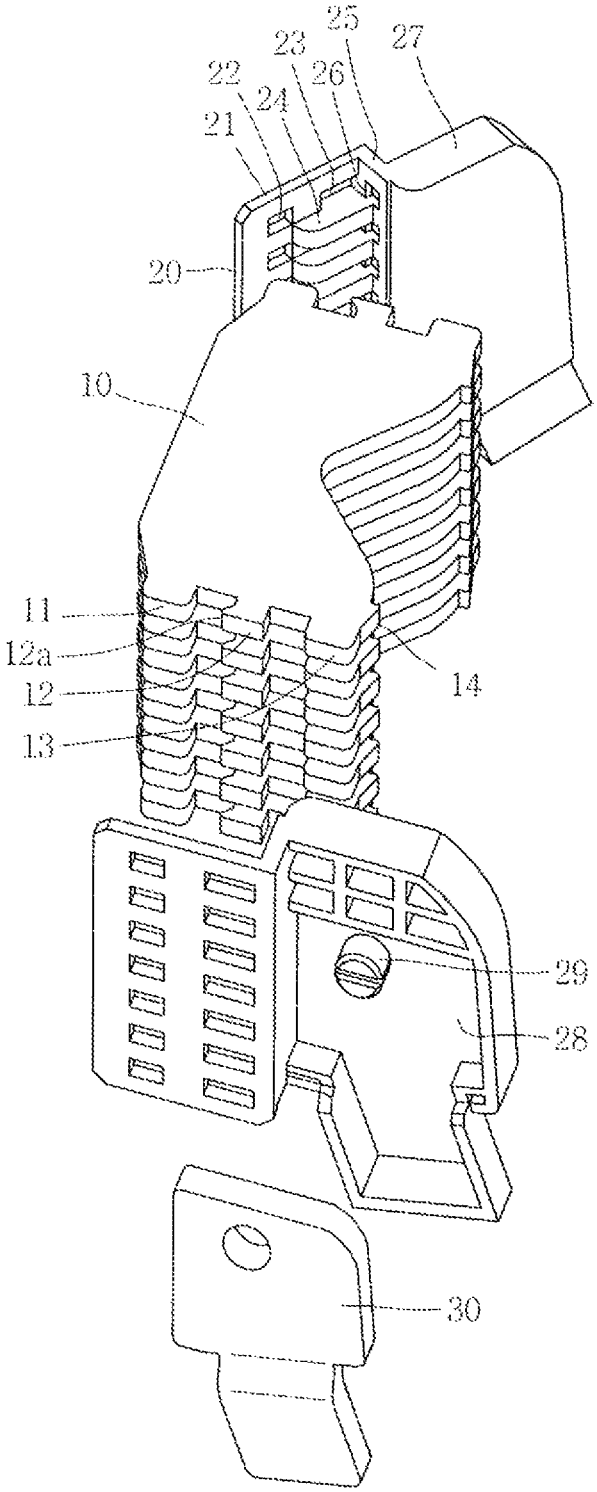
FIG. 6 is a perspective view illustrating an arc extinguishing unit of an MCCB according to an exemplary embodiment of the present disclosure.
Figure 7:
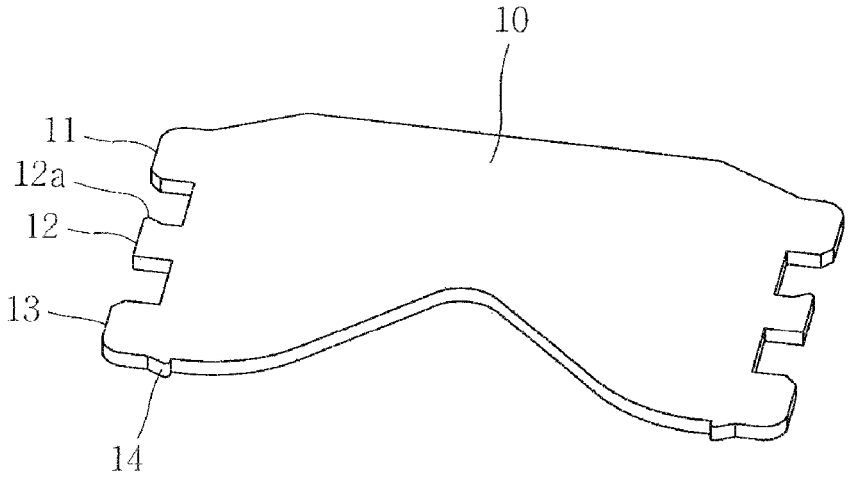
FIG. 7 is a perspective view of grids of FIG. 6.
Figure 8:
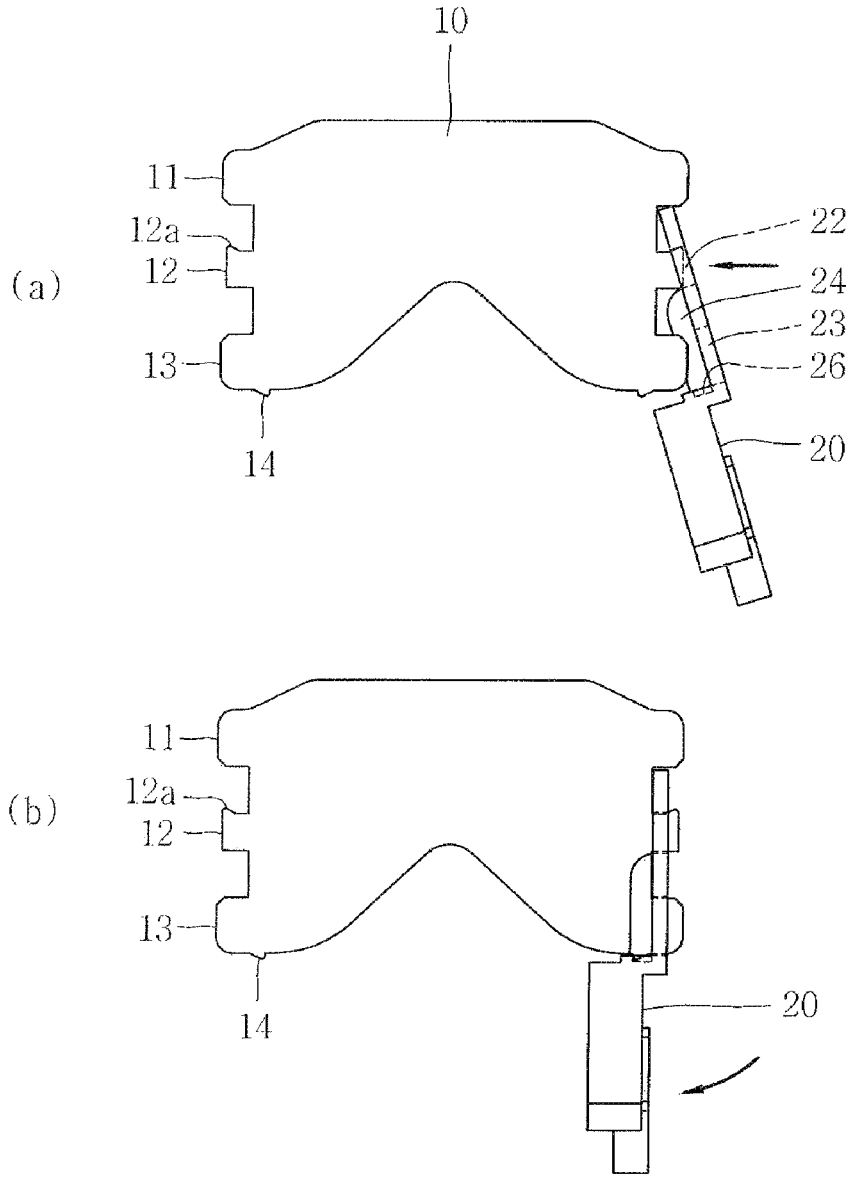
FIG. 8 is a view illustrating an operation of the arc extinguishing unit of an MCCB according to an exemplary embodiment of the present disclosure.

FIG. 6 is a perspective view illustrating an arc extinguishing unit of an MCCB according to an exemplary embodiment of the present disclosure. FIG. 7 is a perspective view of grids of FIG. 6. FIG. 8 is a view illustrating an operation of the arc extinguishing unit of an MCCB according to an exemplary embodiment of the present disclosure.

An arc extinguishing unit of an MCCB according to an exemplary embodiment of the present disclosure will be described in detail with reference to the accompanying drawings.

In the arc extinguishing unit of an MCCB according to an exemplary embodiment of the present disclosure, components such as a casing, a stator connected to a load and a power source, a mover rotatably installed within the casing such that it is brought into contact with or separated from the stator, and the like are identical to those of the related art, so a description and illustration thereof will be omitted.

The grids 10 are configured as flat plates formed of a ferromagnetic metal. A plurality of protrusions are formed on lateral surfaces of the grids 10. In an exemplary embodiment, upper protrusions 11, intermediate protrusions 12, and lower protrusions 13 may be formed to be protruded from the respective lateral surfaces of the grids 10. Each intermediate protrusion 12 has the first stop projection 12*a* formed to be protruded from an upper end portion thereof. The second stop projection 14 is formed to be protruded from a lower surface of each grid 10 having the lower protrusion 13 inwardly. The second stop projection 14 may be formed to have a size equal to that of the first stop projection 12*a* and be symmetrical to the first stop projection 12*a*. When viewed based on a lower corner of the lower protrusion 13, the first stop projection 12*a* and the second stop projection 14 are formed to face outwardly, so, when the side plates 20 are coupled to the grids 10, the first stop projection 12*a* and the second stop projection 14 serve to provide force pulling the both ends such that the side plates 20 and the grids 10 may not be easily separated.

A lower surface of each grid 10 has a deep and wide recess, forming one surface of the arc chamber.

A plurality of grids 10 are integrally laminated at predetermined intervals, and serve to divide arc generated when the movable contactor is separated from the fixed contactor.

The side plates 20 include two-stage flat plates having a step cross-section. A lower plate of each cap side magnet 20 formed to have a step will be referred to as a first flat plate 21, a portion vertically bent from the lower plate will be referred to as a connection portion 25, and an upper plate of the cap side magnet 20 vertically bent again from the connection portion 25 such that it is parallel to the lower plate will be referred to as a second flat plate 27.

First and third installation recesses 22 and 23 are formed in the first flat plate 21 of the cap side magnet 20 to allow the intermediate protrusion 12 and the lower protrusion 13 of the grid 10 are inserted. Here, a length of the first installation hole 22 may be equal to or slightly smaller than a length of the inner side of the intermediate protrusion 12, namely, a length excluding the first stop projection 12*a*. A length of the third installation hole 23 may be equal to or slightly smaller than a length of the lower protrusion 13. This is designed in consideration of inserting type coupling or force inserting type coupling. The number of the first and third installation recesses 22 and 23 may be equal to the number of the intermediate and lower protrusions 12 and 13 in a corresponding manner.

A support protrusion 24 is formed between the third installation recesses 23 to provide bearing power by virtue of shear force and frictional contact when the first flat plate 21 is coupled to the grids 10. Also, the grids 10 may be coupled by means of the support protrusions 24 with a predetermined interval maintained therebetween.

The first flat plate 21 may be coupled to the grids 10 to form an arc chute.

The second flat plate 27 forms an arc chamber together with a lower surface of the grids 10. An inner surface of the second flat plate 27 may be formed to be smooth. Also, an insulating material such as nylon, or the like, may be provided on the inner surface of the second flat plate 27 so as to be decomposed by a high temperature to generate an arc extinguishing gas when an arc is generated.

The lateral magnet 30 is coupled to a rear surface of the second flat plate 27. To this end, the second flat plate 27 is formed to be thicker than the first flat plate, and an accommodation recess 28 having a shape corresponding to that of the lateral magnet 30 may be formed in the rear surface of the second flat plate 27. Also, a fixing hook 29 may be formed to be protruded from the accommodation recess 28 to allow the lateral magnet 30 to be easily fastened and receive bearing power.

The connection portion 25 is formed between the first flat plate 21 and the second flat plate 27 such that the connection portion 25 is perpendicular to the respective flat plates. The connection portion 25 may be formed to have a plate shape. The connection portion 25 may have the second installation hole 26 formed in a position corresponding to the second stop projection 14 when the grids 10 are coupled. As the second stop projection 14 is insertedly coupled into the second installation hole 26 and the first stop projection 12*a* is insertedly coupled into the first installation hole 22, the grids 10 and the cap side magnet 20 are fixedly coupled. A step may be formed in the corner where the connection portion 25 and the second flat plate 27 are contiguous, in a length direction.

Preferably, the first flat plate 21, the connection portion 25, and the second flat plate 27 may be integrally formed through a molding operation, or the like.

Hereinafter, a coupling process of the arc extinguishing unit of the MCCB according to the exemplary embodiment of the present disclosure will be described. FIG. 8 is a view illustrating an operation of the arc extinguishing unit of an MCCB according to an exemplary embodiment of the present disclosure.

The first installation hole 22 of the cap side magnet 20 is inserted into the intermediate protrusion 12 of the grid 10. Here, in a state in which the cap side magnet 20 is sloped to the outside downwardly, the first installation hole 22 is inserted into and caught in the first stop projection 12*a* of the intermediate protrusion 12. As the cap side magnet 12 is pressurized downwardly and pressed inwardly, the second stop projection 14 of the grid 10 is inserted into the second installation hole 26 formed in the connection portion 25.

As the first installation hole 22 of the cap side magnet 20 is caught by the first stop projection 12*a* of the grid 10, the cap side magnet 20 is pressed in an outer direction on one side thereof, and as the second installation hole 26 of the cap side magnet 20 is caught by the second stop projection 14 of the grid 10, the cap side magnet 20 is pressed in an inward direction on the other side thereof. Thus, the cap side magnet 20 is stably maintained in a coupled state, without being released from the grids 20.

The operation of the arc extinguishing unit of an MCCB according to the exemplary embodiment of the present disclosure may be summed up as follows. As described above, the fixed contact of the stator and the movable contact of the mover are maintained in a contact state at a rated current, and when a fault current such as an overcurrent or a short circuit current occurs, the mover is separated from the stator due to electrodynamic repulsion force exerted between the fixed contact and the movable contact, interrupting the current. When the mover is separated, an arc is generated between the fixed contact and the movable contact, and the generated arc moves to the arc chute. The arc is divided by the grids 10 of the arc chute to increase an arc voltage to be higher than a source voltage to thus limit the short circuit current to extinguish the arc. Meanwhile, an arc extinguishing effect is also obtained by an arc extinguishing gas generated by the second flat plate 27 of the cap side magnet 20.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. An arc extinguishing unit of a molded case circuit breaker (MCCB) including a casing, a stator connected to a load or a power source, and a mover rotatably installed within the casing such that it is brought into contact with or separated from the stator, the arc extinguishing unit comprising:

a plurality of grids arranged at predetermined intervals in an outer side of a movement trace of the mover;

a pair of side plates including two-stage flat plates having a step cross-section and including a first flat plate fixing one end portions of the grids to form an arc chute and a second flat plate forming an arc chamber together with a lower surface of the grids; and a pair of lateral magnets fixedly installed on rear surfaces of the second plates, wherein an intermediate protrusion formed on a lateral surface of each of the grids has a first stop projection formed on one side thereof, a second stop projection is formed on a lower surface of each grid, a first installation hole is formed on the first plate to allow the intermediate protrusion to be inserted therein, and a connection portion formed between the first flat plate and the second flat plate has a second installation hole to which the second projection is inserted.

2. The arc extinguishing unit of claim 1, wherein an upper protrusion and a lower protrusion are formed above and below the intermediate protrusion, respectively, on both sides of the grids.

3. The arc extinguishing unit of claim 2, wherein a third installation hole is formed in the first flat plate to allow the lower protrusion to be insertedly coupled therein.

4. The arc extinguishing unit of claim 3, wherein a support protrusion is formed between the third installation holes to provide bearing power by virtue of shear force and frictional contact when the grids are coupled to the side plates and to serve to separate the respective grids at predetermined intervals.

5. The arc extinguishing unit of claim 1, wherein the first stop projection and the second stop projection are formed in an outer side based on a contact point between the first flat plate and the connection portion.

* * * * *